United States Patent [19]

Jurich, III

[11] 4,195,381

[45] Apr. 1, 1980

[54] CLEANING APPARATUS FOR A REVOLVER

[76] Inventor: Mike Jurich, III, 2113 Trudie Dr., San Pedro, Calif. 90731

[21] Appl. No.: 45,222

[22] Filed: Jun. 4, 1979

[51] Int. Cl.[2] ..... B08B 9/00; A46B 15/00

[52] U.S. Cl. ..... 15/104.2; 15/160

[58] Field of Search ..... 15/104.16, 104.165, 15/104.2, 160, 164

[56] References Cited

U.S. PATENT DOCUMENTS

| | | | |
|---|---|---|---|
| 1,556,494 | 10/1925 | Cooper | 15/104.2 X |
| 2,049,365 | 7/1936 | Follett | 15/164 |
| 3,076,988 | 2/1963 | Mills | 15/164 X |

*Primary Examiner*—Edward L. Roberts

*Attorney, Agent, or Firm*—W. Edward Johansen

[57] ABSTRACT

The present invention is a cleaning attachment mechanism for cleaning a plurality of the chambers of the cylinder of a revolver simultaneously for use in combination with a cleaning apparatus for cleaning the barrel, which is rifled, of the revolver. The cleaning apparatus includes a handle, a first shaft having a length which is equal to the length of the cylinder and a mechanically coupling device which rotatably couples the handle to the first shaft. The cleaning apparatus also includes a second shaft which is equal in length to the length of the barrel of the revolver plus the length of the first shaft and a second mechanically coupling device which rigidly couples the second shaft to the first shaft. The second shaft can be unattached. The cleaning apparatus further includes a cylindrical wire brush which is rigidly coupled to the second shaft and which is adapted to rotate within the barrel of the revolver in order to clean it. The cleaning attachment mechanism includes a triangularly shaped adaptor which is rigidly coupled to the first shaft adjacent to the second mechanically coupling device and which has a plurality of short, parallel shafts which are mechanically coupled to the triangularly shaped adaptor and disposed perpendicularly thereto and parallelly to the first shaft. The cleaning attachment mechanism also includes a plurality of cylindrical wire brushes each of which is rigidly coupled to one of the short shafts and is adapted to forceably slide through one of the chambers of the cylinder of the revolver.

1 Claim, 2 Drawing Figures

CLEANING APPARATUS FOR A REVOLVER

BACKGROUND OF THE INVENTION

1. Field of the Invention

The present invention relates to a cleaning apparatus for a revolver and more particularly to a cleaning apparatus which is adapted to clean both the rifled gun bore of the revolver and a plurality of chambers of the cylinder of the revolver.

2. Description of the Prior Art

U.S. Pat. No. 2,601,691, entitled Fluid Pressure Device for Cleaning Rifled Gun Bores and Chambers, issued to Marion R. Dyer on July 1, 1952, teaches a cleaning apparatus which is used with cleaning solvent to remove anti-corrosive materials from rifled gun bores and adapted to be moved axially in the bore. The cleaning apparatus includes a central orifice head, a tabular support for head extending on opposite sides thereof to form a fluid passage to the head, first and second spiral brushes mounted on the support one on each side of the head, a flexible stopper having a diameter slightly in excess of the land diameter of the bore secured to the support one on the side of each brush opposite the head, and two sets of nozzles on the head in fluid communication with said tubular member. The nozzles are generally radially disposed, one set of nozzles being axially inclined in the direction of the first brush, and the other set of nozzles being axially inclined in the direction of the second brush whereby a high velocity discharge of fluid cleaning solvent entrapped between the flexible stopper will be effected at the rifle grooves when said fluid is applied from a high pressure source to the head and nozzles through the tabular member.

U.S. Pat. No. 3,480,982, entitled Apparatus for Cleaning Gun Barrels, issued to Arthur C. Saunders Dec. 2, 1969, teaches an apparatus and a method of cleaning the inner bore of a gun barrel are disclosed in which the apparatus includes an inner longitudinal bore for guiding a cleaning rod through the barrel bore and a funnel-shaped, conical bore extension of the guide provides for the centering of the rod during its reciprocation and rotation during the cleaning operation. The method involves the inserting of the rod within the guiding longitudinal bore, centering a facing end of the gun barrel within the conical shaped extension, and the holding of the guide against the barrel face to maintain an alignment of the bores during reciprocation and rotation of the rod within the bores.

U.S. Pat. No. 2,409,916, entitled Firearm Cleaning Rod Centralizer, issued to Charles W. Varcoe on Oct. 22, 1946, teaches a cleaning device for forearms which includes a cleaning rod of sufficiently smaller diameter than the bore of the barrel so as to be spaced from it on all sides when in the bore, a swab on the rod for cleaning the bore of the barrel, a hand grip on the rod for moving the swab through the bore, a guiding and a centralizing member for the rod provided with a longitudinal straight passage circular in cross section and substantially the diameter of the rod in which the rod has a sliding guiding fit. The member includes a body portion providing a hand grip and provided with a cone shaped recess in one end communicating with the passage and adapted to receive the end of the barrel. The recess is of a larger diameter than the barrel at its larger end and smaller than the barrel at its smaller end so that the end of the barrel engages the inclined side walls of the recess intermediate its ends to center the passage and rod in alignment with the bore to prevent rubbing of the rod on the surface of the bore during the cleaning operation.

U.S. Pat. No. 3,286,293, entitled Stop Means for Gun Cleaning Device, issued to Charles F. Eckert on Nov. 22, 1966, teaches a stop means for a gun cleaning device which includes a cylindrical body with a central longitudinal axis of symmetry having an opening therethrough along the axis for receiving the rod of a gun cleaning device and a front plane surface, a protective washer unit positioned along the front plane surface of the body for contacting the muzzle end of a gun, and locking mechanism received within the body for detachably securing the body with the rod for positioning and preventing motion between the rod and the body.

U.S. Pat. No. 4,144,609, entitled Brush for the Cleaning of Firearms Bores and Gun Barrels, issued to Werner Dubson Mar. 20, 1979, teaches a gun cleaning brush for cleaning firearms bores containing rifling. The gun cleaning brush includes a central elongate spindle and a plurality of spaced circular brush unit mechanisms adjacent each other mounted freely rotatable on the spindle. Each of the brush unit mechanisms is independently self-adjusting for alignment with the rifling within the bore. The cleaning brush also includes end pieces at each end of the spindle, transition cones between each of the end pieces and the plurality of brush unit means; and a device which secures the end pieces to the spindle preventing breakage of the end pieces from the spindles. One of the end pieces is internally threaded for receiving one end of the spindle which is externally threaded. A shoulder is formed on the spindle at the external threading. A steel sleeve has a flange which is positioned in an enlarged portion of the bore. One end of the spindle received through the sleeve such that the shoulder abuts against the flange when the one end piece is tightened.

The other of the end pieces is attached to a polishing rod and also has an axial bore containing an internally threaded portion and a smooth portion. The threaded portion receives external threads on the other end of the spindle and the smooth portion is in tight fitting relationship with an unthreaded smooth portion of the spindle. A pin secures the other end of the spindle to the other end piece and passes through the smooth portion of the axial bore and the unthreaded smooth portion of the spindle.

There have been inventions relating to the cleaning of rifled gun barrels, but there have been few inventions which relate to the cleaning of the chambers of the cylinder of a revolver. In most instances the cleaning apparatus used to clean the rifled gun barrel is the one used to clean each chamber of the cylinder of the revolver. Each chamber is cleaned separately thereby making this a time consuming task. There is no rifling in the chambers so there is no requirement that the cleaning brush rotate within the chamber. However, the cleaning brush must be pushed all the way through the chamber before it can be removed. The time consuming task is especially annoying on the shooting range where a cleaned revolver is necessary in order to insure uniform results and where the revolver requires many cleanings because its user is shooting a large number of rounds.

SUMMARY OF THE INVENTION

In view of the foregoing factors and conditions characteristic of the prior art it is a primary object of the present invention to provide a cleaning attachment mechanism for use in combination with a cleaning apparatus for a revolver which allows the user of the revolver to simultaneously clean a plurality of chambers of the cylinder of the revolver.

It is also another object of the present invention to provide a cleaning attachment mechanism which can be easily fabricated and attached to a conventional cleaning apparatus for a revolver.

In accordance with an embodiment of the present invention a cleaning attachment mechanism for cleaning a plurality of the chambers of the cylinder of a revolver simultaneously for use in combination with a cleaning apparatus for cleaning the barrel, which is rifled, of the revolver is disclosed. The cleaning apparatus includes a handle, a first shaft having a length which is equal to the length of the cylinder and a mechanically coupling device which rotatably couples the handle to the first shaft. The cleaning apparatus also includes a second shaft which is equal in length to the length of the barrel of the revolver plus the length of the first shaft and a second mechanically coupling device which rigidly couples the second shaft to the first shaft. The second shaft can be unattached. The cleaning apparatus further includes a cylindrical wire brush which is rigidly coupled to the second shaft and which is adapted to rotate within the barrel of the revolver in order to clean it. The cleaning attachment mechanism includes a triangularly shaped adaptor which is rigidly coupled to the first shaft adjacent to the second mechanically coupling device and which has a plurality of short, parallel shafts which are mechanically coupled to the triangularly shaped adaptor and disposed perpendicularly thereto and parallelly to the first shaft. The cleaning attachment mechanism also includes a plurality of cylindrical wire brushes each of which is rigidly coupled to one of the short shafts and is adapted to forceably slide through one of the chambers of the cylinder of the revolver.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the Figures.

DESCRIPTION OF THE PREFERRED EMBODIMENT

Figure 1:
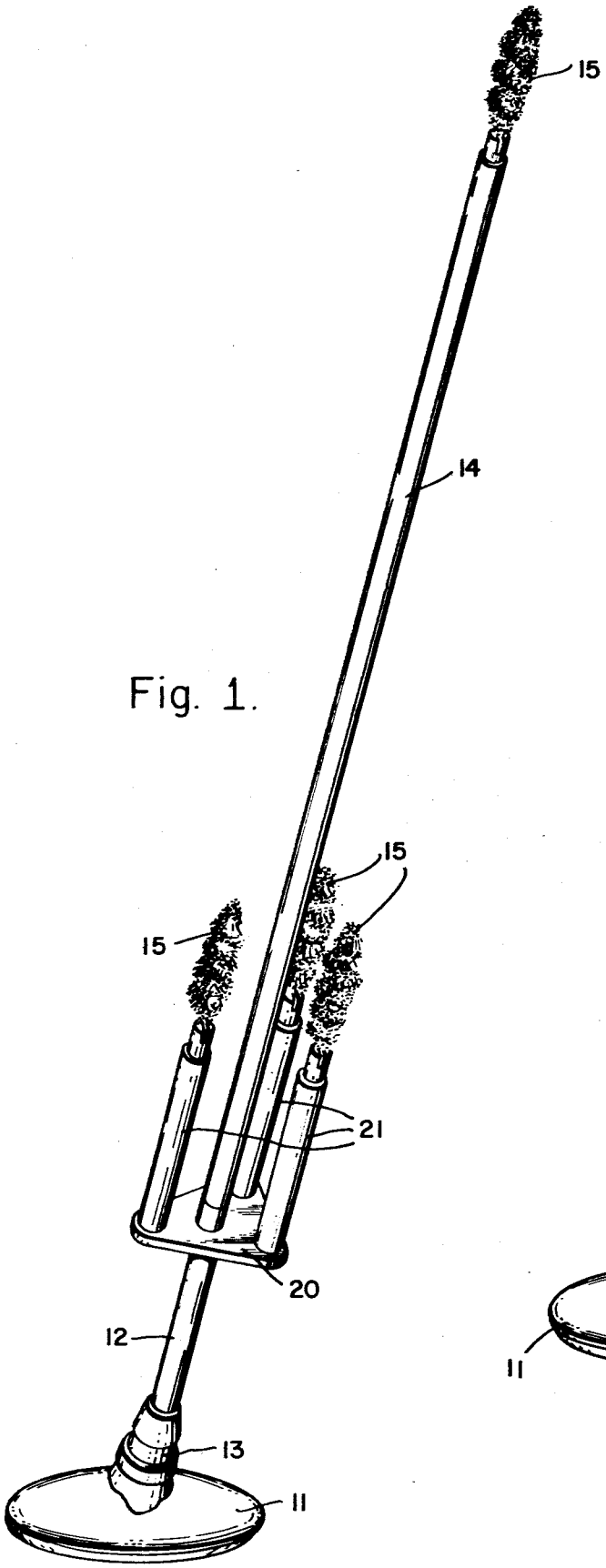
FIG. 1 is a perspective drawing of a cleaning apparatus for a revolver which is adapted to clean the barrel thereof and which includes a cleaning attachment mechanism which has been constructed in accordance with the principles of the present invention.

In order to best understand the present invention it is necessary to refer to the following description of its preferred embodiment in conjunction with the accompanying drawing. Referring to FIG. 1 a cleaning apparatus for cleaning a revolver includes a handle 11 and a first shaft 12 which has a length which is equal to the length of the cylinder of the revolver. A first mechanically coupling device 13 rotatably couples the handle 11 to the first shaft 12. The cleaning apparatus also includes a second shaft 14 which is equal in length to the length of the barrel of the revolver plus the length of the first shaft. A second mechanically coupling device rigidly couples the first shaft 12 to the second shaft 14. The second shaft 14 can also be unattached. The cleaning apparatus further includes a cylindrical wire brush 15 which is rigidly coupled to the second shaft 14 and which is adapted to rotate within the barrel of the revolver, which is rifled, in order to clean it.

Figure 2:
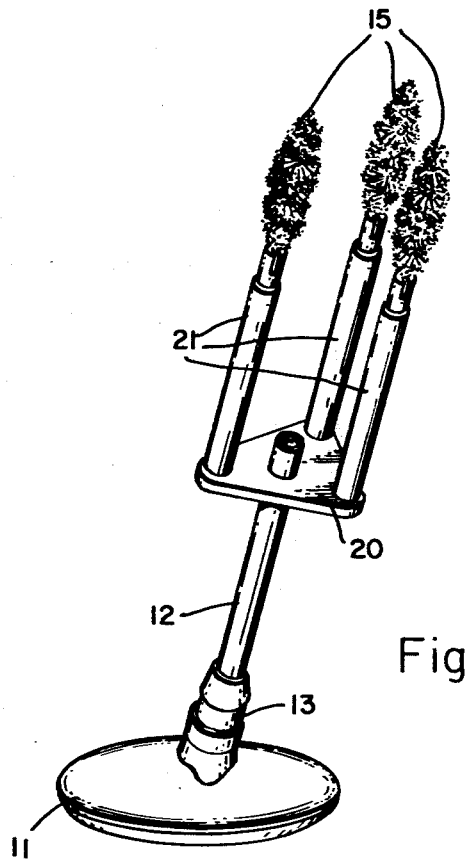
FIG. 2 is a perspective drawing of the cleaning apparatus for a revolver and the cleaning apparatus attachment of FIG. 1 which is adapted to clean a plurality of chambers of the cylinder thereof.

Referring now to FIG. 2 the preferred embodiment of the present invention is a cleaning attachment mechanism 20 which is a triangularly shaped plate that is rigidly coupled to the first shaft 12 and that has a plurality of short, parallel shafts 21. Each of the short, parallel shafts 21 is mechanically coupled to the cleaning attachment mechanism 20 and is disposed parallelly thereto and parallelly to the first shaft 12. There is also a cylindrical wire brush which is rigidly attached to each of the short, parallel shafts 21 and which is adapted to forceably slide through one of the chambers of the cylinder of the revolver.

The shape of the cleaning attachment mechanism 20 is critical in that the construction of a revolver prohibits a round plate or a square plate because in order to be able to place the short, parallel shafts 21 in each corner the plate would have to be too large. There is, however, no necessity that the brushes rotate within each chamber of the cylinder as it is with the single brush within the barrel of the revolver which is rifled. The only requirement is that each brush 15 must be able to pass all the way through the chamber of the cylinder so that it can be pulled out. If each brush 15 cannot pass all the way through the chamber of the cylinder then it will jam therewithin.

The inventor has developed a cleaning attachment mechanism that enables the user of a revolver to clean several chambers of the cylinder thereof simultaneously. Among the other advantages of the invention is that it can be adapted to fit a commercially available cleaning apparatus for cleaning a revolver.

Furthermore, it should be noted that the schematics of the device have not been drawn to scale and that distances of and between the Figures are not be considered significant.

Accordingly, it is intended that the foregoing disclosure and showings made in the drawing shall be considered as illustrations of the principles of the present invention.

What is claimed is:

1. A cleaning attachment mechanism for cleaning a plurality of the chambers of the cylinder of a revolver simultaneously for use in combination with a cleaning apparatus for cleaning the barrel, which is rifled, of the revolver which includes:

a. a handle;

b. a first shaft having a length which is equal to the length of the cylinder;

c. a first mechanically coupling device for rotatably coupling the first shaft to the handle;

d. a second shaft which is equal in length to the length of the barrel of the revolver plus the length of the first shaft, said second shaft can be unattached;

e. a second mechanically coupling device for rigidly coupling the first shaft to the second shaft; and f. a cylindrical wire brush rigidly coupled to the second shaft and adapted to rotate within the barrel of the revolver thereby cleaning it, said cleaning attachment mechanism comprising:

a. a triangularly shaped adaptor which is rigidly coupled to the first shaft adjacent to the second mechanically coupling device;

b. a plurality of short parallel shafts mechanically coupled to said triangularly shaped adaptor and disposed perpendicularly thereto and parallelly to the first shaft; and c. A plurality of cylindrical wire brushes each of which is rigidly coupled to one of said short shafts and is adapted to forceably slide through one of the chambers of the cylinder of the revolver.

* * * * *